US009415262B2

(12) United States Patent
An

(10) Patent No.: US 9,415,262 B2
(45) Date of Patent: Aug. 16, 2016

(54) HANDGRIP

(71) Applicant: Tae Jin An, Incheon (KR)

(72) Inventor: Tae Jin An, Incheon (KR)

( * ) Notice: Subject to any disclaimer, the term of this patent is extended or adjusted under 35 U.S.C. 154(b) by 0 days.

(21) Appl. No.: 14/649,462

(22) PCT Filed: Dec. 18, 2013

(86) PCT No.: PCT/KR2013/011819
§ 371 (c)(1),
(2) Date: Jun. 3, 2015

(87) PCT Pub. No.: WO2014/104647
PCT Pub. Date: Jul. 3, 2014

(65) Prior Publication Data

US 2015/0290491 A1 Oct. 15, 2015

(30) Foreign Application Priority Data

Dec. 24, 2012 (KR) ..... 10-2012-0152034

(51) Int. Cl.
*A63B 23/16* (2006.01)
*A63B 21/00* (2006.01)
(Continued)

(52) U.S. Cl.
CPC ..... *A63B 23/16* (2013.01); *A63B 21/0004* (2013.01); *A63B 21/00069* (2013.01);
(Continued)

(58) Field of Classification Search
CPC .... A63B 23/16; A63B 23/14; A63B 21/4035; A63B 21/0004; A63B 23/03508; A63B 21/023; A63B 21/4019; A63B 21/05; A63B 2023/003; A63B 21/00061; A63B 21/0428; A63B 21/4017; A63B 21/02; A63B 21/0421; A63B 21/045; A47J 43/26
USPC ..... 482/44–50; D21/684; 30/120.1–120.5
See application file for complete search history.

(56) References Cited

U.S. PATENT DOCUMENTS 2,837,334 A * 6/1958 Long ..... A63B 23/16 482/49
D192,367 S * 3/1962 Marvosh ..... 482/49
(Continued)

FOREIGN PATENT DOCUMENTS

KR 2002-0033005 A 5/2002
KR 10-0625851 B1 9/2006
(Continued)

OTHER PUBLICATIONS

International Search Report issued in PCT/KR2013/011819 mailed on Apr. 29, 2014 (2 pages).

*Primary Examiner* — Oren Ginsberg
*Assistant Examiner* — Andrew S Lo
(74) *Attorney, Agent, or Firm* — Osha Liang LLP

(57) ABSTRACT

The present invention provides a hand grip comprising: right and left arms in which upper portions thereof are coupled to each other by a rotating shaft so as to rotate around the rotating shaft, thereby approaching each other and being distanced from each other, and lower portions thereof can be held by the hand of a user; and a resilient means for providing an elastic force in the direction obstructing the approaching of the right and left arms. The resilient means comprises spring members symmetrically installed on the front and back sides of the upper portions of the right and left arms, respectively; each of the front and back side spring members comprises a compression spring, and right and left spring support portions interposed therebetween to support the same in a compressible manner; and each of the left spring support portions and the right spring support portions of the front and back side spring members are connected to each other by left and right spring member coupling shafts and interposing the upper portion of the left arm or the upper portion of the right arm therebetween, and are operated in an integrated manner.

11 Claims, 12 Drawing Sheets

(51) Int. Cl.
*A63B 21/02* (2006.01)
*A63B 21/04* (2006.01)
*A63B 21/05* (2006.01)

(52) U.S. Cl.
CPC ..... *A63B21/02* (2013.01); *A63B 21/023* (2013.01); *A63B 21/025* (2013.01); *A63B 21/0421* (2013.01); *A63B 21/05* (2013.01)

(56) References Cited

U.S. PATENT DOCUMENTS 3,066,713 A * 12/1962 Wilcox ..... A47J 43/26 30/120.5
3,349,621 A * 10/1967 Mullen ..... A61B 5/225 482/122
3,706,114 A * 12/1972 Waechter ..... A47G 21/065 30/120.1
4,433,364 A * 2/1984 Noble ..... A63B 21/00043 200/60
4,550,495 A * 11/1985 Fornes ..... A47J 43/26 30/120.3
4,554,737 A * 11/1985 Bartels ..... A47J 43/26 30/120.3
4,614,034 A * 9/1986 Russell, Jr. ..... A47J 43/26 30/120.3
4,713,874 A * 12/1987 Schwartz ..... H01R 43/0421 29/566.4
4,753,434 A * 6/1988 Salvino ..... A63B 23/16 482/121
4,943,047 A * 7/1990 Noble ..... A61B 5/225 340/321
5,060,934 A * 10/1991 Winston ..... A63B 21/0004 482/126
5,833,580 A * 11/1998 Chiu ..... A63B 23/16 482/126
5,926,957 A * 7/1999 Russell, Jr. ..... A47J 43/26 30/120.3
D416,299 S * 11/1999 Hug ..... D21/684
D438,266 S * 2/2001 Levrett ..... D21/684
6,319,175 B1 * 11/2001 Wu ..... A63B 21/023 482/126
6,786,849 B1 * 9/2004 Faulconer ..... A63B 21/0004 482/121
7,077,787 B1 * 7/2006 Wiesman ..... A63B 21/025 482/127
7,438,669 B1 * 10/2008 Bloom ..... A63B 21/0004 482/1
7,789,815 B2 * 9/2010 An ..... A63B 21/0004 482/126
7,824,311 B1 * 11/2010 Hsu ..... A63B 21/4047 482/126
D647,581 S * 10/2011 Batiste ..... D21/684
D654,126 S * 2/2012 Eckermann ..... D21/684
8,142,335 B1 * 3/2012 Leach ..... A63B 21/0728 482/107
D680,178 S * 4/2013 An ..... D21/684
8,915,824 B2 * 12/2014 Roberts ..... A63B 23/14 482/49
D742,463 S * 11/2015 An ..... D21/684
2004/0003687 A1 * 1/2004 An ..... A63B 21/0004 81/427
2006/0246832 A1 * 11/2006 Sellars, Jr. ..... A22C 29/024 452/103
2007/0167288 A1 * 7/2007 Lin ..... A63B 23/16 482/49
2008/0103026 A1 * 5/2008 An ..... A63B 23/16 482/49
2010/0255956 A1 * 10/2010 An ..... A63B 21/0004 482/49
2014/0038786 A1 * 2/2014 Garcia ..... A63B 23/16 482/49

FOREIGN PATENT DOCUMENTS

KR 2006-0116774 A 11/2006
KR 10-0760083 B1 9/2007

* cited by examiner

HANDGRIP

TECHNICAL FIELD

The present invention relates to a handgrip, and more particularly, to a handgrip having a structure capable of considerably increasing a resilient force acting between right and left arms, and being easily manufactured.

BACKGROUND ART

A handgrip is a kind of exercise equipment used to train muscle strength of a hand or a forearm, and includes one pair of arms and a spring which applies a force in a direction disturbing an approaching motion of the arms.

Using the handgrip, a user repeatedly performs a motion which applies a force and approaches the arms while overcoming the resilient force provided by the spring, and a motion which releases the force and turns the arms to their original positions, thereby increasing the muscle strength of his/her hand or forearm.

There has been disclosed a conventional handgrip which includes one pair of arms and a spring of which both ends are fixed to the right and left arms, respectively, and a center portion is formed in a coil shape. However, since the conventional handgrip has a constant intensity of the resilient force provided by the spring, it is impossible to change strength of the handgrip, i.e., the intensity of the resilient force provided by the spring.

To solve such a disadvantage of the conventional handgrip, in Korean Patent No. 0760083 granted to the applicant of the present invention, there has been disclosed a handgrip capable of controlling the intensity of the resilient force.

The handgrip capable of controlling the intensity of the resilient force includes one pair of first and second arms of which upper portions are rotatably coupled to each other by a rotating shaft, a spring guide having a first guide supported by a pin so as to rotate toward an inside of the first arm and a second guide coupled to the first guide so as to move in a lengthwise direction, and a spring which is disposed between the first and second guides of the spring guide. The second guide is formed so that a position of an end thereof may move up and down in an inside of the second arm, and thus a position of the spring may be changed, and the intensity of the resilient force may be controlled.

The handgrip capable of controlling the intensity of the resilient force, as described above, has an advantage that a user can adjust the intensity of the resilient force in accordance with his/her muscle strength, but also has a disadvantage that it is limited in providing a high intensity for an athlete.

First, since the spring is located between insides of the one pair of arms, there is a limitation in adding a spring or increasing a size of the spring.

Second, the arms are formed of a plastic material using a mold, and, as the strength of the spring is increased, the arms formed of the plastic material may not sufficiently support the resilient force. To solve such disadvantages, a metallic material may be used, but there is another problem that a manufacturing cost is increased.

That is, the metallic material may ensure a sufficient supporting force due to its own strength, even when it has a simple shape, and thus a simple manufacturing method other than a method using the mold, which can reduce a cost, is required.

Due to such disadvantages, the handgrip used for an ordinary person's casual exercise may control the intensity of the resilient force. However, in the case of the handgrip having the high intensity for the athlete, the center portion thereof still includes the coil-shaped spring.

However, since the handgrip having the high intensity may not control the intensity of the resilient force, separate handgrips should be used according to their intensities, and also as a thickness of a spring wire is increased, the right and left arms are not arranged on the same plane, but may be twisted from each other, and thus a grip feeling may be deteriorated.

DISCLOSURE

Technical Problem

The present invention is directed to providing a handgrip in which spring members are installed on front and back sides of right and left arms, respectively, so as to provide a high intensity of a resilient force, and a design thereof is easily changed to increase the resilient force of the spring members, and also which is easily manufactured.

Technical Solution

One aspect of the present invention provides a handgrip including right and left arms in which upper portions thereof are coupled to each other by a rotating shaft so as to rotate around the rotating shaft, thereby approaching each other and being spaced apart from each other, and lower portions thereof are held by a user's hand, and a resilient means for providing a resilient force in the direction obstructing the approaching of the right and left arms, wherein the resilient means includes spring members symmetrically installed on front and back sides of the upper portions of the right and left arms, respectively, and each of the front and back side spring members includes a compression spring, and right and left spring support portions in which the compression spring is interposed therebetween to be supported in a compressible manner, and each of the left spring support portions and the right spring support portions of the front and back side spring members is connected to each other by left and right spring member coupling shafts, while the upper portion of the left arm or the upper portion of the right arm is interposed therebetween, and is operated in an integrated manner.

The left arm may include a cylindrical left grip disposed at a lower portion thereof, and a left plate body disposed at an upper portion thereof and configured in a plate coupled with the left grip, and the right arm may include a cylindrical right grip disposed at a lower portion thereof, and a right plate body disposed at an upper portion thereof and configured in a plate coupled with the right grip.

The right arm may further include front and back side connecting plates which are coupled to front and back sides of the right plate body, respectively, and of which upper ends extend left so as to interpose an upper end of the left plate body therebetween, and the left plate body is interposed between the front and back side connecting plates and then rotatably coupled therewith by the rotating shaft installed to pass therethrough. And an arc-shaped sliding surface centering on the rotating shaft may be formed at a right upper end surface of the left plate body, and a corresponding sliding surface having a corresponding shape and engaged with the sliding surface to be slidably rotated may be formed at a left upper end surface of the right plate body.

The left and right plate bodies and the front and back side connecting plates may be manufactured by cutting a plate material formed of a metallic material, and the left and right grips may be formed of a metal rod.

The left spring member coupling shaft configured to connect the left spring support portions of the front and back side spring members may be rotatably installed through a coupling shaft through-hole formed at the left plate body, and the right spring member coupling shaft configured to connect the right spring support portions of the front and back side spring members may be installed at a left surface of the right plate body to be movable in a lengthwise direction.

A plurality of resilient force control grooves may be formed at a left surface of the upper portion of the right arm in the lengthwise direction, and a middle portion of the right spring member coupling shaft may be coupled to one of the resilient force control grooves so as to control an intensity of the resilient force.

A stop member disposed between the front and back side connecting plates coupled to the front and back sides of the right plate body, respectively, and rotatably coupled to the front and back side connecting plates to be rotated around a hinge shaft, and having a left end contact surface which is in contact with a contact part formed at a left end thereof to be directed to an upper end of the left plate body may be disposed at an upper surface of the right plate body, and the stop member may have a restriction position in which the left end contact surface is disposed to be in contact with the contact part and thus to restrict a rotation between the left and right arms within a predetermined range, and a control position in which the stop member is deviated from the restriction position by rotating around the hinge shaft, and the left and right arms are allowed to be rotated with respect to each other to a position in which the resilient force of the spring members is not applied.

An elastic pressing part configured to press a lower surface of the stop member may be further formed at the upper surface of the right plate body, such that the stop member is prevented from being freely rotated by its own weight. And the elastic pressing part may include a spring installed at an inside of a spring installing groove formed at the upper surface of the right plate body, and a bead-shaped locking ball elastically supported by the spring so as to press the lower surface of the stop member, and a plurality of catching grooves to which the locking ball is coupled may be formed at the lower surface of the stop member.

Advantageous Effects

According to the handgrip of the present invention having the above-described structure, since the spring members are provided on the front and back sides of the right and left arms, respectively, and thus at least one pair of spring members are installed, it is possible to provide the high intensity of the resilient force. Further, since the spring members are disposed at an outside, and are not interfered with other structures, a thickness and a wound diameter of a spring wire can be controlled according to design strength, and thus it is advantageous in providing the handgrip having the high intensity.

Also, according to the present invention, since plate members manufactured in a cutting manner of a plate material formed of a metallic material through laser processing or press processing are used as main elements, the main elements can be easily manufactured, and also since the grip part formed of the metal rod can be easily manufactured, a manufacturing cost is low, compared with a molding manner using a mold, and the handgrip can be easily manufactured.

Therefore, according to the present invention, the handgrip which has the low manufacturing cost and the high intensity and in which the resilient force can be controlled can be provided.

MODES OF THE INVENTION

Figure 1:
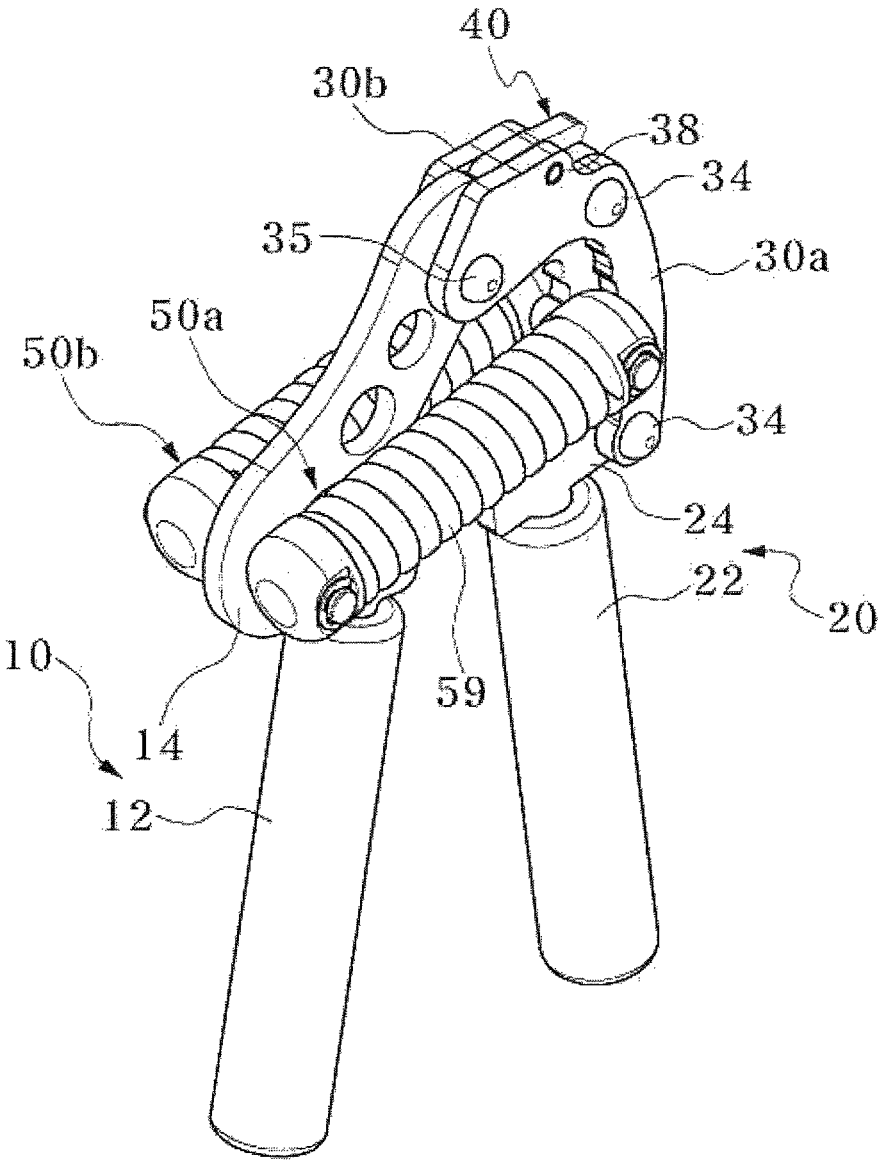
FIG. 1 is a perspective view of a handgrip according to one embodiment of the present invention.
Figure 2:
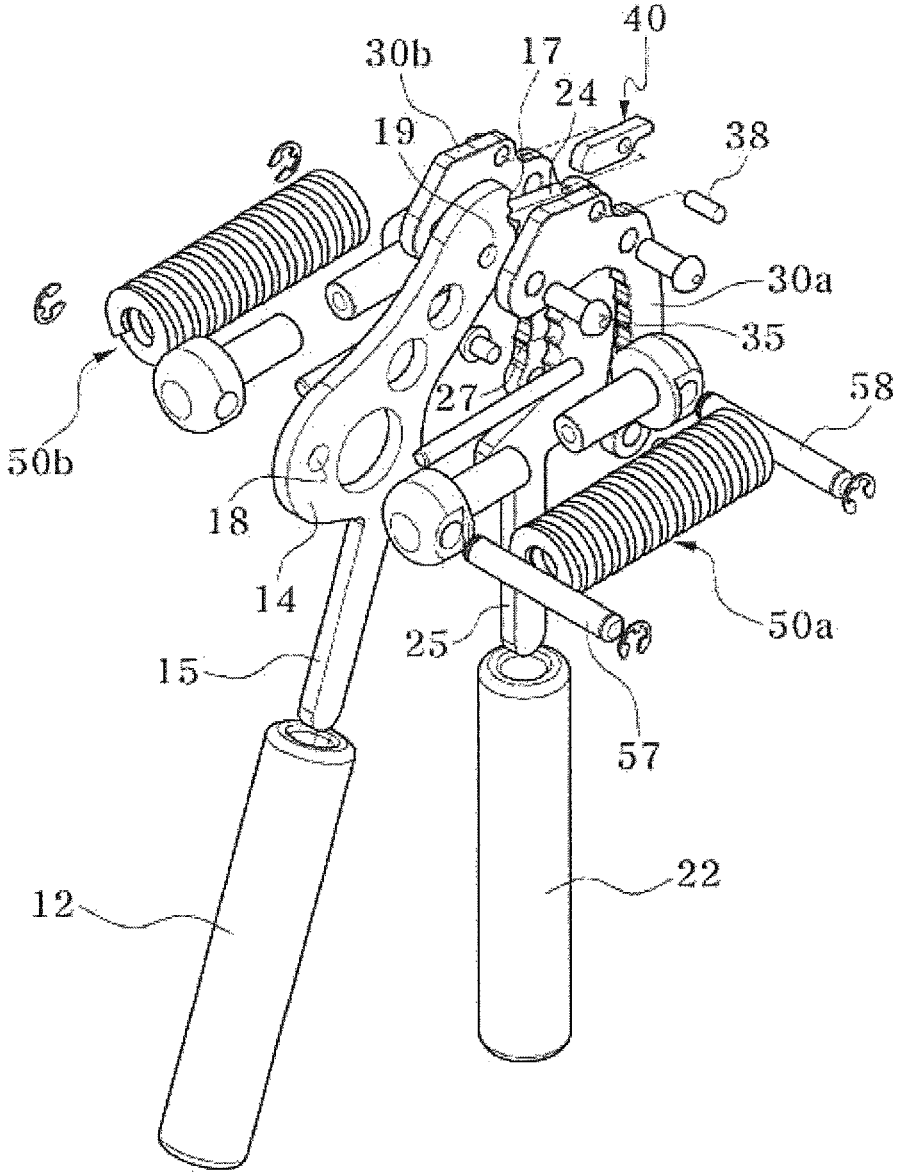
FIG. 2 is an exploded view of the handgrip illustrated in FIG. 1.
Figure 3:
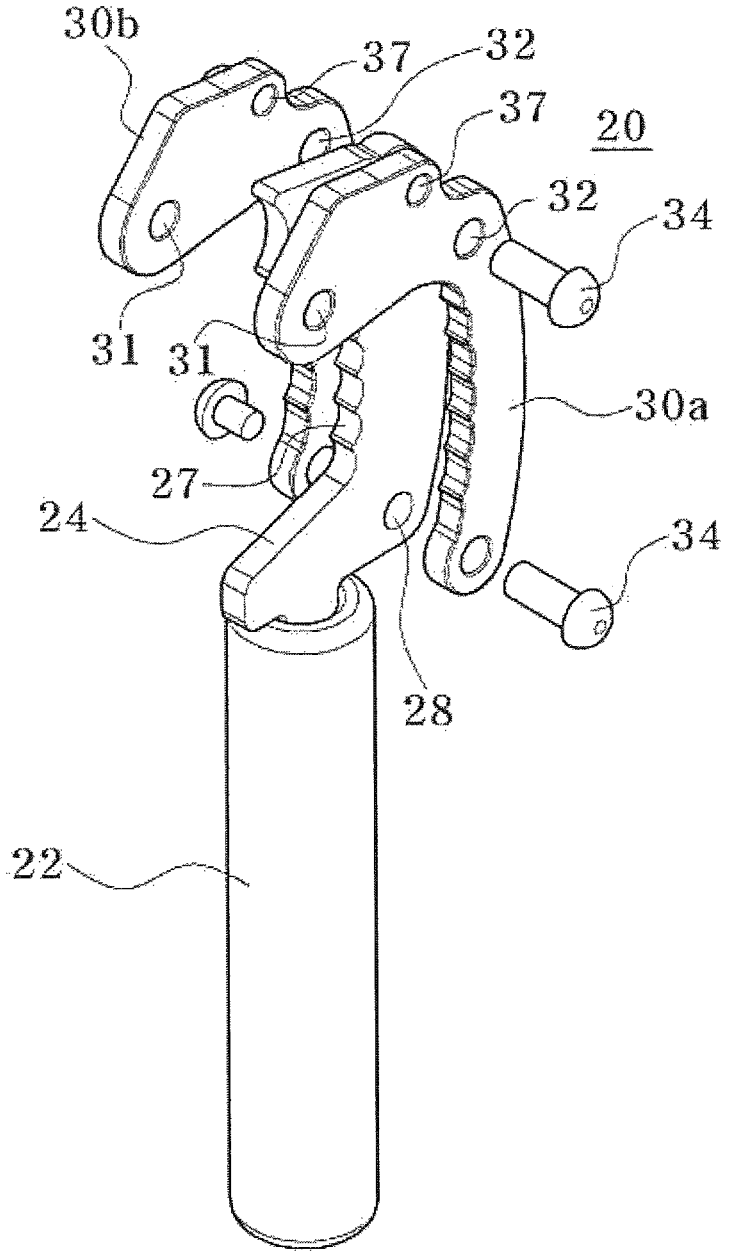
FIG. 3 is a view illustrating a front and back side connecting plate of the handgrip according to one embodiment of the present invention.
Figure 4:
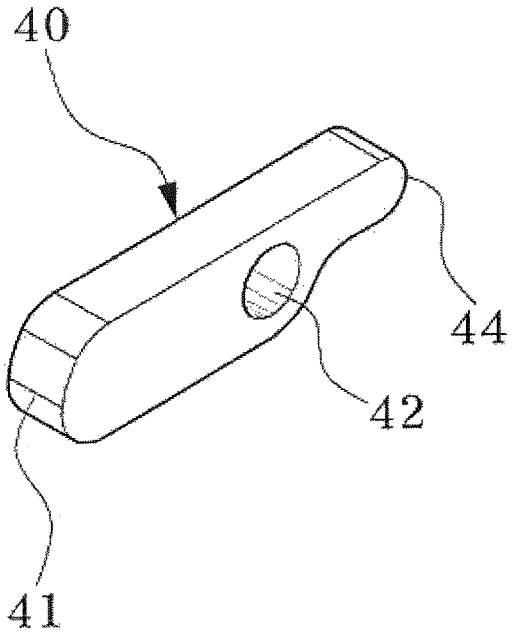
FIG. 4 is a view illustrating a stop member of the handgrip according to one embodiment of the present invention.
Figure 5:
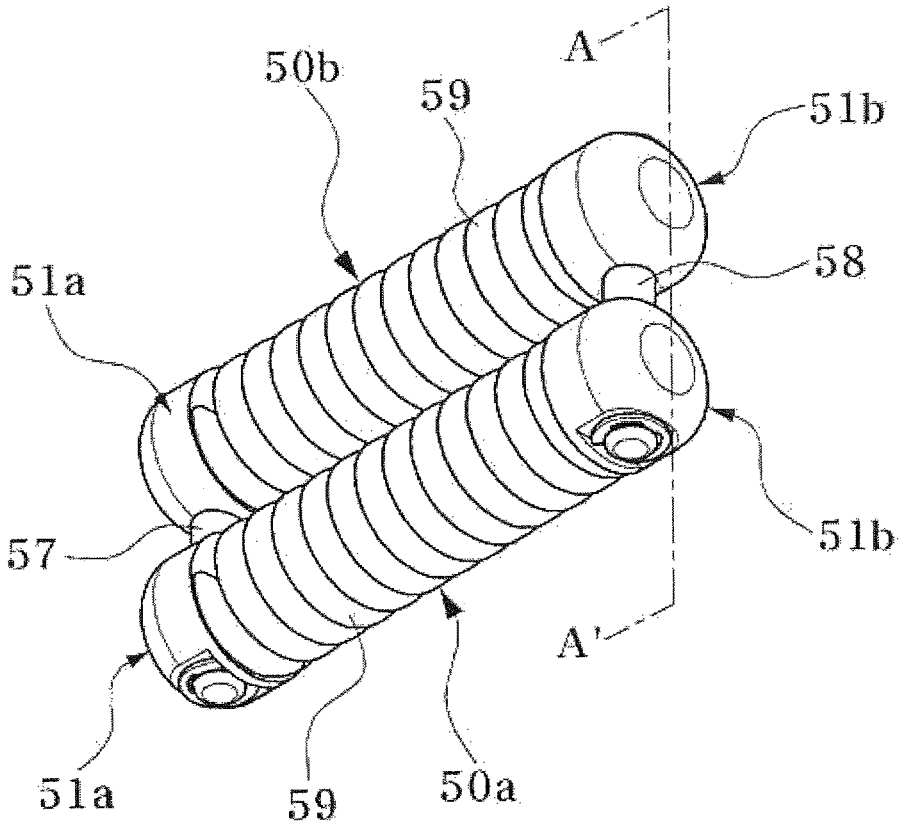
FIG. 5 is a perspective view illustrating a coupled state of a spring member of the handgrip according to one embodiment of the present invention.
Figure 6:
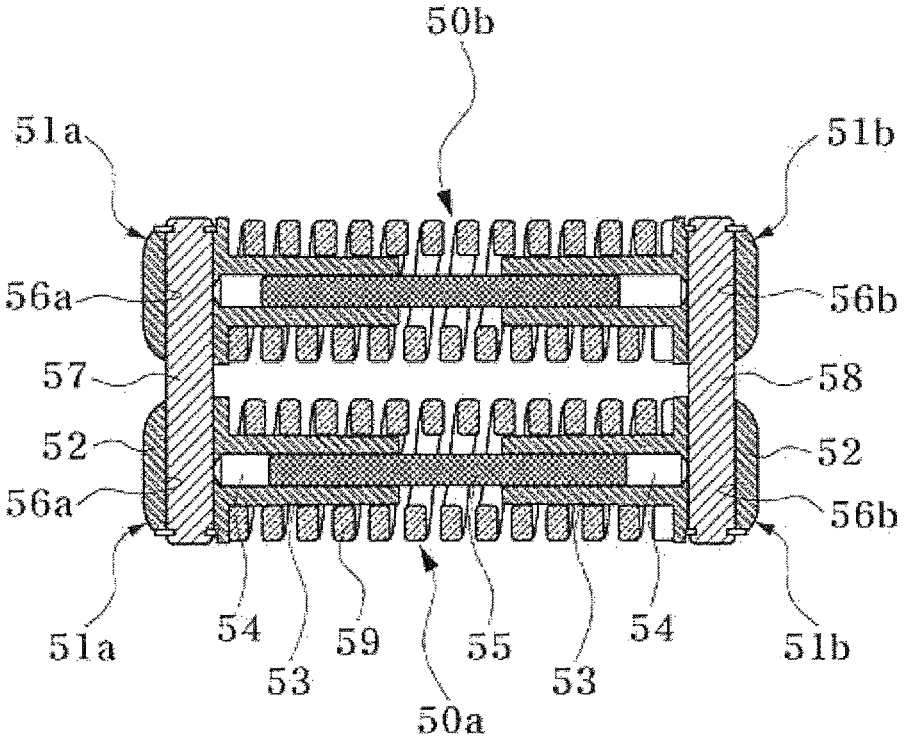
FIG. 6 is a cross-sectional view taken along line A-A' of the spring member illustrated in FIG. 5.

Hereinafter, exemplary embodiments of a handgrip according to the present invention will be described in detail with reference to the accompanying drawings.

Referring to FIGS. 1 to 7, the handgrip according to the present invention includes one pair of arms 10 and 20 including a left arm 10 and a right arm 20, and one pair of spring members 50*a* and 50*b* symmetrically installed on front and back sides of the left and right arms 10 and 20, respectively and connected to each other.

Upper portions of the left and right arms 10 and 20 are coupled to each other by a rotating shaft 35 so as to rotate around the rotating shaft 35, thereby approaching each other and being spaced apart from each other.

The left arm 10 includes a left grip 12 configured to form a lower portion thereof, and a left plate body 14.

The left grip 12 is formed of a cylindrical metal rod in which a coupling hole 13 is formed at a center of an upper end thereof in a lengthwise direction.

The left plate body 14 is manufactured of a plate material formed of a metallic material which is machined through laser processing, press processing, or the like, and a coupling part 15 inserted and coupled into the coupling hole 13 of the left grip 12 is formed at a lower end thereof. Also, the left plate body 14 has a shape which is bent and extends in a right-upward direction.

A rotating shaft coupling hole 19 is formed to pass through an upper portion of the left plate body 14 in a front and rear direction, and a sliding surface 16 having an arc shape centering on the rotating shaft coupling hole 19 is formed at an right upper end surface of the left plate body 14, and a contact part 17 which is in contact with a stop member 40 is formed so as to protrude upward toward an upper side of the sliding surface 16.

The left plate body 14 is disposed between the spring members 50*a* and 50*b*, and a coupling shaft through-hole 18 is formed at a left surface of a lower portion thereof. Left spring support portions 51*a* of the front and back side spring members 50*a* and 50*b* are connected with each other by a left spring member coupling shaft 57 passing through the coupling shaft through-hole 18, while the left plate body 14 is interposed therebetween.

The right arm 20 includes a right grip 22 configured to form a lower portion thereof, a right plate body 24, and front and back side connecting plates 30*a* and 30*b*.

Like the left grip 12, the right grip 22 is formed of a cylindrical metal rod in which a coupling hole 23 is formed at a center of an upper end thereof in a lengthwise direction.

Like the left plate body 14, the right plate body 24 is manufactured of a plate material formed of a metallic material which is machined through the laser processing, the press processing, or the like, and a coupling part 25 inserted and coupled into the coupling hole 23 of the right grip 22 is formed at a lower end thereof. Also, the right plate body 24 has a shape which is bent and extends upward.

A correspondingly shaped, i.e., concave arc-shaped corresponding sliding surface 26 which is engaged with the arc-shaped sliding surface 16 so as to be slidably rotated is formed at a left upper end surface of the right plate body 24. Therefore, when the left arm 10 and the right arm 20 are rotated around the rotating shaft 35, a sliding motion occurs between the sliding surface 16 and the corresponding sliding surface 26, and thus an action force is dispersed. Therefore, unlike a manner supported by only the rotating shaft 35, there is no risk to be damaged, even when a high intensity of the resilient force is applied.

A plurality of resilient force control grooves 27 formed to have semicircular cross sections in a lengthwise direction are formed at a left surface of the right plate body 24 which faces the left plate body 14. Connecting plate fixing holes 28 through which a fixing member 34 for fixing the front and back side connecting plates 30*a* and 30*b* passes to be inserted therein are formed at surfaces of upper and lower sides thereof.

The front side connecting plate 30*a* and the back side connecting plate 30*b* are disposed and fixed to front and back sides of the right plate body 24, respectively. The front side connecting plate 30*a* and the back side connecting plate 30*b* are manufactured of a plate material formed of a metallic material machined by the laser processing, the pressing processing or the like, and formed to be symmetric to each other.

The front and back side connecting plates 30*a* and 30*b* are fixed together to the right plate body 24 by the fixing member 34 which passes through the connecting plate fixing holes 28 of the right plate body 24 so as to fix the front and back side connecting plates 30*a* and 30*b*, and fixing holes 32 are formed at positions corresponding to the connecting plate fixing holes 28.

Upper ends of the front and back side connecting plates 30*a* and 30*b* extend left so that an upper end of the left plate body 14 is interposed therebetween, and have a corresponding rotating shaft coupling hole 31 corresponding to the rotating shaft coupling hole 19, and thus the left plate body 14 is rotatably coupled by the rotating shaft 35 fastened while the rotating shaft coupling hole 19 and the corresponding rotating shaft coupling hole 31 coincide with each other. That is, the left arm 10 and the right arm 20 are coupled so as to be rotated around the rotating shaft 35.

According to the present invention, since the left and right plate bodies 14 and 24 forming the left and right arms 10 and 20, and the front and back side connecting plates 30*a* and 30*b* are manufactured in a manner in which the plate material formed of a metallic material is cut through the laser processing, the pressing processing or the like and then assembled, it is not necessary to manufacture a mold, and thus the manufacturing cost may be reduced, and also it may be easily manufactured. Also, since the construction elements are manufactured by the metallic material, a supporting force required in the handgrip having the high intensity may be provided. Furthermore, the left and right plate bodies 14 and 24 may be easily coupled with the left and right grips 12 and 22 formed of the metal rod.

Therefore, according to the present invention, the left and right arms 10 and 20 may be prevented from being damaged by the resilient force provided by the spring members 50*a* and 50*b* while accomplishing ease of manufacture.

According to the present invention, the stop member 40 is disposed on an upper surface of the right plate body 24. The stop member 40 is disposed between the front and back side connecting plates 30*a* and 30*b*, and coupled so as to be rotated around a hinge shaft 38. To this end, hinge holes 37 and 42 in which the hinge shaft 38 is inserted are formed at the front and back side connecting plates 30*a* and 30*b* and the stop member 40.

A control piece 44 is formed to protrude from a right end of the stop member 40. The control piece 44 is used when the stop member 40 is pushed and then rotated to a right side around the hinge shaft 38.

The stop member 40 is disposed so that a left end contact surface 41 is in contact with the contact part 17 of the left plate body 14. The stop member 40 controls a spacing degree of the left arm 10 with respect to the right arm 20. That is, when a user applies a strain to his/her hand such that the left and right arms 10 and 20 approach each other, and then releases the strain, the left and right arms 10 and 20 are rotated around the rotating shaft 35 by the resilient force in a spacing direction. When the left and right arms 10 and 20 are spaced a predetermined range or more, the contact part 17 of the left arm 10 is in contact with the left end contact surface 41 of the stop member 40, and thus an additional rotation of the left arm 10 respect to the right arm 20 is restricted. The left and right arms 10 and 20 may be rotated with respect to each other to only a position in which the contact part 17 of the left arm 10 is in contact with the left end contact surface 41 of the stop member 40. The position (referring to FIG. 7) in which the left end contact surface 41 of the stop member 40 is disposed to be in contact with the contact part 17 of the left arm 10 is a restriction position of the stop member 40.

Figure 11:
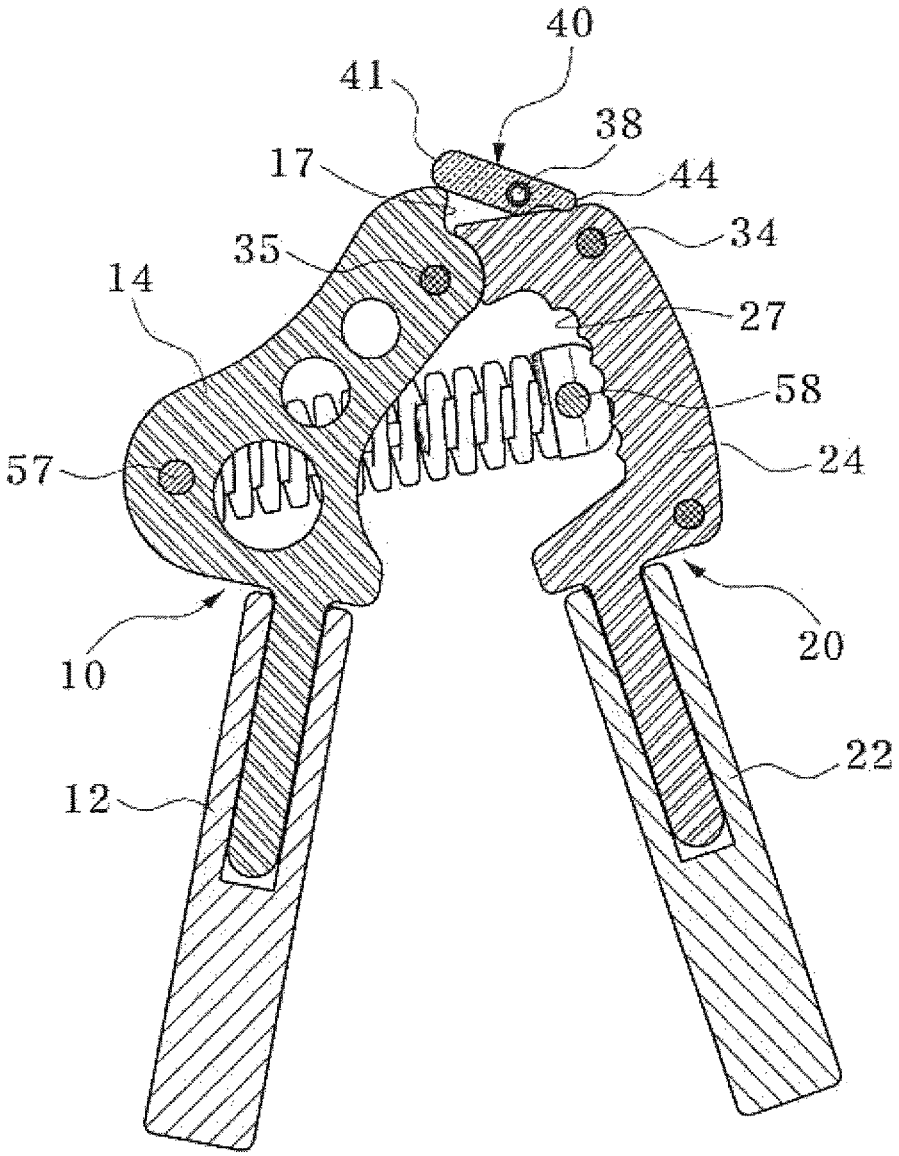
FIG. 11 is a cross-sectional view illustrating an operation of the stop member for adjusting a resilient force in the handgrip according to one embodiment of the present invention.

Meanwhile, the stop member 40 may push the control piece 44 and may rotate the stop member 40 to a right side around the hinge shaft 38 (referring to FIG. 11). In this case, since the left end contact surface 41 of the stop member 40 strays from its original position, and thus does not restrict a movement of the left arm 10 within the predetermined range, the left arm 10 and the right arm 20 may be allowed to be spaced to a position in which the resilient force is not applied by the spring members 50*a* and 50*b*. A position of the stop member 40 at this time is a control position of the stop member 40. When the stop member 40 is disposed at the control position, the spring members 50*a* and 50*b* is in a no-load state, and thus an intensity of the resilient force can be controlled by moving the position of the spring members 50*a* and 50*b* (this will be described again in detail with reference to FIG. 12). When a control of the resilient force is completed, the stop member 40 is returned to its original position, while the left and right arms 10 and 20 approach each other.

According to the present invention, one pair of spring members 50*a* and 50*b* which are installed at the front and back sides of the upper portions of the left and right arms 10 and 20 to be symmetric to each other and connected with each other are installed.

Each of the spring members 50*a* and 50*b* includes a compression spring 59, and left and right spring support portions 51*a* and 51*b* which are disposed at both ends of the compression spring 59 so that the compression spring 59 is interposed therebetween so as to be compressibly supported.

Each of the left and right spring support portions 51*a* and 51*b* includes a contact support portion 52 which an end of the compression spring 59 is in contact with and also supported by, and a guide 53 which extends toward an inside of each compression spring 59. The guide 53 has a guide groove 54 which is formed in a lengthwise direction and in which a guide rod 55 is slidably inserted. Therefore, the compression spring 59 may be guided between the left and right spring support portions 51*a* and 51*b* to be compressed and released in the lengthwise direction. In the illustrated embodiment, the guide rod 55 is separately formed, and both ends of the guide rod 55 are inserted into the guide grooves 54 disposed at both sides. However, the guide rod 55 may be integrally formed with one guide 53. Alternatively, the guide 53 may be formed so that the guide rod 55 is connected to one spring supporting part, and the guide groove 54 is provided at the other spring supporting part.

According to the present invention, the front and back side spring members 50*a* and 50*b* are connected with each other and integrally operated. To this end, through-holes 56*a* and 56*b* are formed at the left and right spring support portions 51*a* and 51*b* of each of the front and back side spring members 50*a* and 50*b*, respectively.

In the front and back side spring members 50*a* and 50*b*, the left spring support portions 51*a* are connected with each other by the left spring member coupling shaft 57, and the right spring support portions 51*b* are connected with each other by a right spring member coupling shaft 58.

First, in coupling of the left spring support portions 51*a*, while the left spring support portions 51*a* are disposed at the front and back sides of the left plate body 14 of the left arm 10, respectively, and the coupling shaft through-hole 18 of the left plate body 14 coincides with the through-holes 56*a* of the left spring support portions 51*a*, the left spring member coupling shaft 57 is inserted and fixed therein. Therefore, the front and back side spring members 50*a* and 50*b* are coupled so as to be integrally rotated around the left spring member coupling shaft 57.

The right spring support portions 51*b* on the front and back sides are also coupled to each other by the right spring member coupling shaft 58 inserted through the through-hole 56*b*. The right spring support portions 51*b* on the front and back sides are also coupled, while the right plate body 24 is interposed therebetween. However, a middle portion of the right spring member coupling shaft 58 is disposed at the resilient force control groove 27, and thus the right spring support portions 51*b* may be movable so as to control the resilient force.

A character (not shown) may be installed at the front and back side connecting plates 30*a* and 30*b* so as to indicate the intensity of the resilient force according to positions of the resilient force control grooves 27, and a protrusion may be installed at portions of the front and back side connecting plates 30*a* and 30*b* and the left surface corresponding to the positions of the resilient force control grooves 27.

Figure 8:
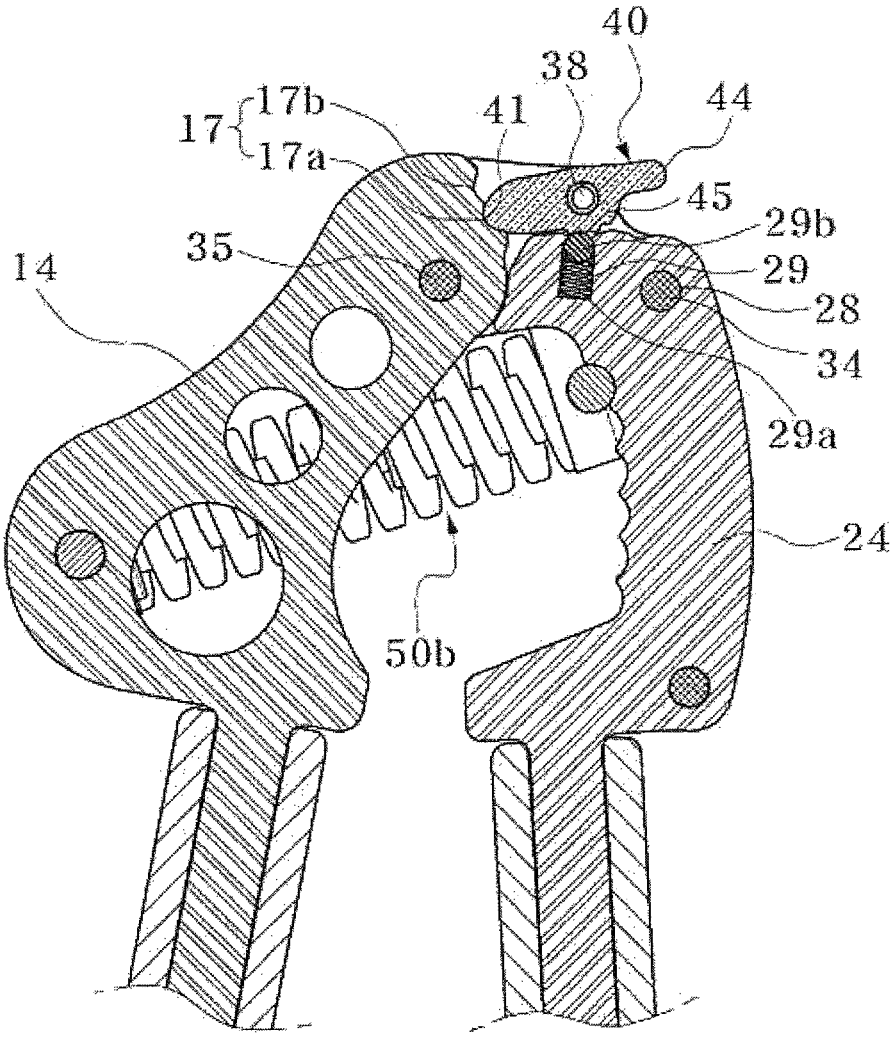
FIG. 8 is a partial cross-sectional view illustrating a handgrip according to another embodiment of the present invention, in which a structure related to the stop member is modified.

FIG. 8 is a partial cross-sectional view illustrating a handgrip according to another embodiment of the present invention, in which a structure related to the stop member is modified, compared with the handgrip according to one embodiment of the present invention. In FIG. 8, the same components as those of the one embodiment of the present invention are designated by the same reference numerals.

Referring to FIG. 8, the handgrip according to the present invention further includes an elastic pressing part which is formed at an upper surface of the right plate body 24 so as to press a lower surface of the stop member 40 and thus to restrict a free rotation of the stop member 40. A plurality of catching grooves 45 are formed at the lower surface of the stop member 40.

The elastic pressing part serves to restrict the free rotation of the stop member 40, and includes a spring installing groove 29 formed at the upper surface of the right plate body 24, a spring 29*a* and a locking ball 29*b*.

The spring installing groove 29 is formed at a position corresponding to a position of a hinge shaft 38 of the stop member 40. The spring 29*a* elastically supports the locking ball 29*b* in the spring installing groove 29, and provides a force which presses the locking ball 29*b* upward, and thus the stop member 40 may be prevented from being freely rotated at the restriction position. According to the present invention, the locking ball 29*b* is formed in a bead shape, and the plurality of catching grooves 45 in which the locking ball 29*b* is partly inserted and coupled are formed at the lower surface of the stop member 40.

Both side edges of an upper end of the spring installing groove 29 are formed to be cupped slightly inward and thus to prevent separation of the bead-shaped locking ball 29*b*. Front and back sides of the spring installing groove 29 are closed by the front and back side connecting plates 30*a* and 30*b*. Since the locking ball 29*b* has the bead shape, the locking ball 29*b* is rotated and moved between the catching grooves 45, when the stop member 40 is operated. Therefore, an operation of the stop member 40 may be performed smoothly.

As described above, the stop member 40 controls the spacing degree of the left arm 10 with respect to the right arm 20 at the restriction position, and serves to push the control piece 44 and thus to rotate the stop member 40 to the right side around the hinge shaft 38, when the user wants to move the positions of the spring members 50*a* and 50*b*, and thus to control the intensity of the resilient force.

However, since there is not a means for maintaining the stop member 40 at the restriction position, the stop member 40 may be deviated from the restriction position according to a motion of the user, regardless of the user's intention, when the handgrip is used. That is, when the user uses the handgrip while stretching his/her hand downward, an upper portion of the handgrip may be directed to the ground, and the stop member 40 may be freely rotated to the control position by its own weight.

However, as illustrated in FIG. 8, when the elastic pressing part is provided at the upper surface of the right plate body 24 so as to restrict the free rotation of the stop member at the restriction position, the locking ball 29*b* pressed upward by the spring 29*a* presses the lower surface of the stop member 40, and thus the stop member 40 is maintained at the restriction position. Therefore, the stop member 40 may be prevented from being rotated without a pushing operation of the control piece 44.

When the catching grooves 45 are formed at the lower surface of the stop member 40, the locking ball 29*b* is coupled to the catching grooves 45 so as to support the stop member 40, and thus the stop member 40 may be further stably supported.

A plurality of contact grooves 17*a* and 17*b* may be formed at the contact part 17 of the left arm 10 so as to correspond to a position of the left end contact surface 41 of the stop member 40 according to a coupling position between the locking ball 29*b* and the catching grooves 45. The left end contact surface 41 of the stop member 40 may be in contact with one of the contact grooves 17*a* and 17*b* according to the coupling position between the locking ball 29*b* and the catching grooves 45, and thus may control the spacing degree of the left arm 10 with respect to the right arm 20. At this time, the spacing degree of the left arm 10 with respect to the right arm 20 may be changed according to positions of the left end contact surface 41 and the contact grooves.

Figure 9:
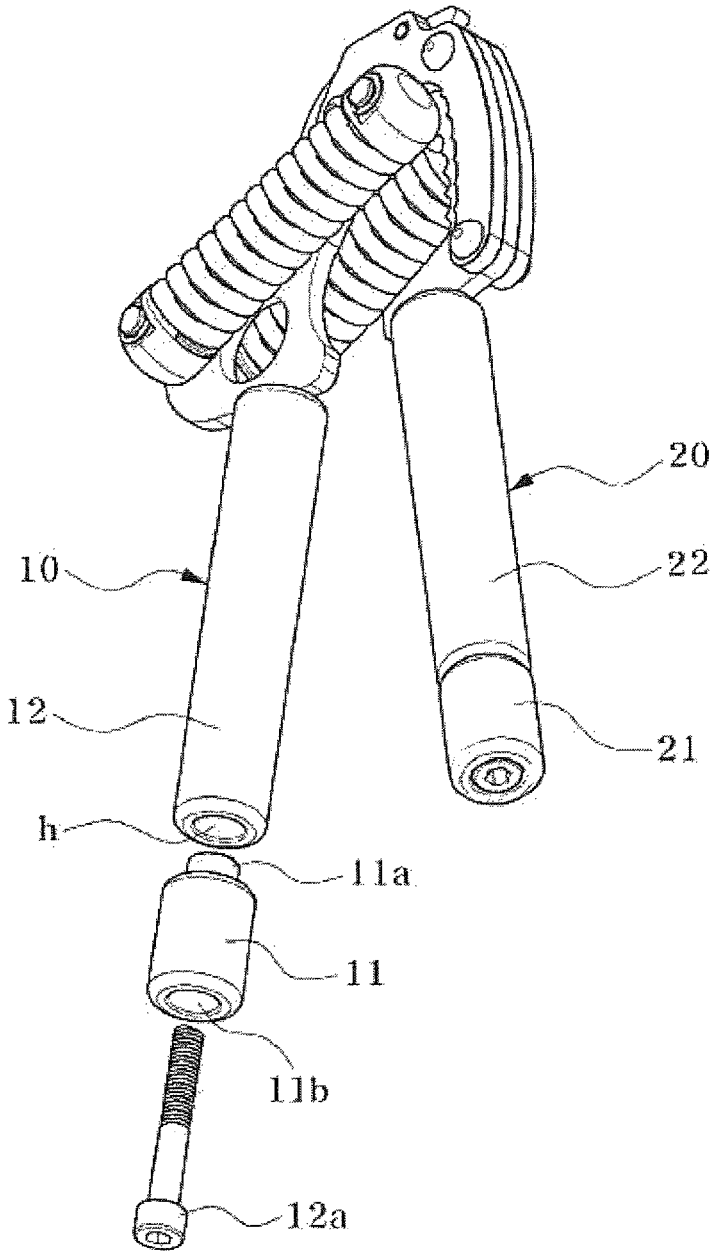
FIG. 9 is an exploded view illustrating still another embodiment of the present invention, in which left and right arms are modified.
Figure 10:
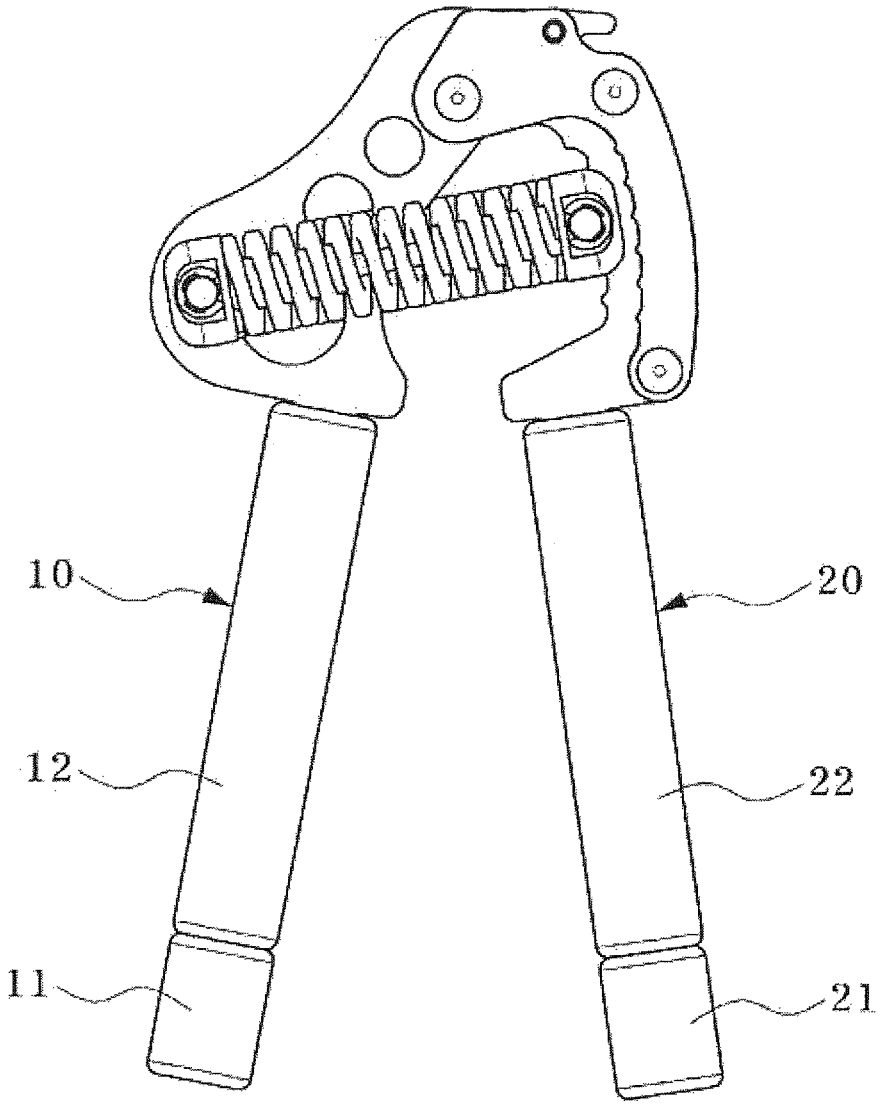
FIG. 10 is a view illustrating a coupled state of the handgrip illustrated in FIG. 9.

FIGS. 9 and 10 are views illustrating a handgrip according to still another embodiment of the present invention, in which the left and right arms are modified. In FIGS. 9 and 10, the same components as those of the one embodiment of the present invention are designated by the same reference numerals.

Referring to FIGS. 9 and 10, the handgrip according to the present invention further includes left and right extending grips 11 and 21. The left and right extending grips 11 and 21 are coupled to the left and right grips 12 and 22 so as to increase a length of each of the left and right grips 12 and 22.

A coupling hole h is formed at a lower end surface of each of the grips 12 and 22. The coupling hole h is formed to correspond to shapes of coupling members 12*a*.

Like the grips 12 and 22, the extending grips 11 and 21 are formed of a cylindrical metal rod, and includes an insertion supporting part 11*a* formed at an upper end of each thereof to be inserted into the coupling hole h, and an insertion hole 11*b* in which the coupling member 12*a* is inserted so as to pass therethrough.

In the handgrip illustrated in FIGS. 9 and 10, when the user does not use the extending grips 11 and 21, the coupling member 12*a* is fastened into the coupling hole h of each of the grips 12 and 22.

However, when the user wants to increase the length of each of the grips 12 and 22, the coupling member 12*a* is separated, and the insertion supporting part 11*a* of each of the extending grips 11 and 21 is inserted into the coupling hole h so that the extending grips 11 and 21 coincide with the grips 12 and 22, and the coupling member 12*a* is inserted and fixed into the coupling hole h of each of the grips 12 and 22 through the insertion hole 11*b*. Therefore, the grips 12 and 22 are increased by the length of the extending grips 11 and 21, respectively.

In the handgrip, a force required when the left and right arms 10 and 20 approach each other depends on the spring members 50*a* and 50*b* as well as a grasping position when the user grasps the grips 12 and 22. As the user grasps the grips 12 and 22 at a position distant from the spring members 50*a* and 50*b*, the required force is relatively reduced.

The handgrip according to the present invention is configured so as to control the intensity of the resilient force. Nevertheless, there is a limitation in a level of the intensity of the resilient force. Even though the handgrip is adjusted to have the smallest intensity of the resilient force, when grasping power of the user does not reach the adjusted resilient force, the user may couple the extending grips 11 and 21 so as to increase the length of each of the grips 12 and 22, and may use the handgrip while grasping the grips 12 and 22 at a position which is more distant from the spring members 50*a* and 50*b*.

Also, the left and right extending grips 11 and 21 allow the user to adjust and use the handgrip according to his/her hand size. In the handgrip, the lengths of the grips 12 and 22 of the left and right arms are manufactured according to an average hand size of normal persons. However, a person may have a relatively large hand size. In the case of the person having the relatively large hand size, the lengths of the grips 12 and 22 of the handgrip adjusted to the average hand size are short, and thus it is inconvenient to use the handgrip.

However, according to the still another embodiment of the present invention, since the user may extend the lengths of the grips 12 and 22 using the extending grips 11 and 21, the person having the larger hand size than the average hand size may use the handgrip without any inconvenience.

Figure 7:
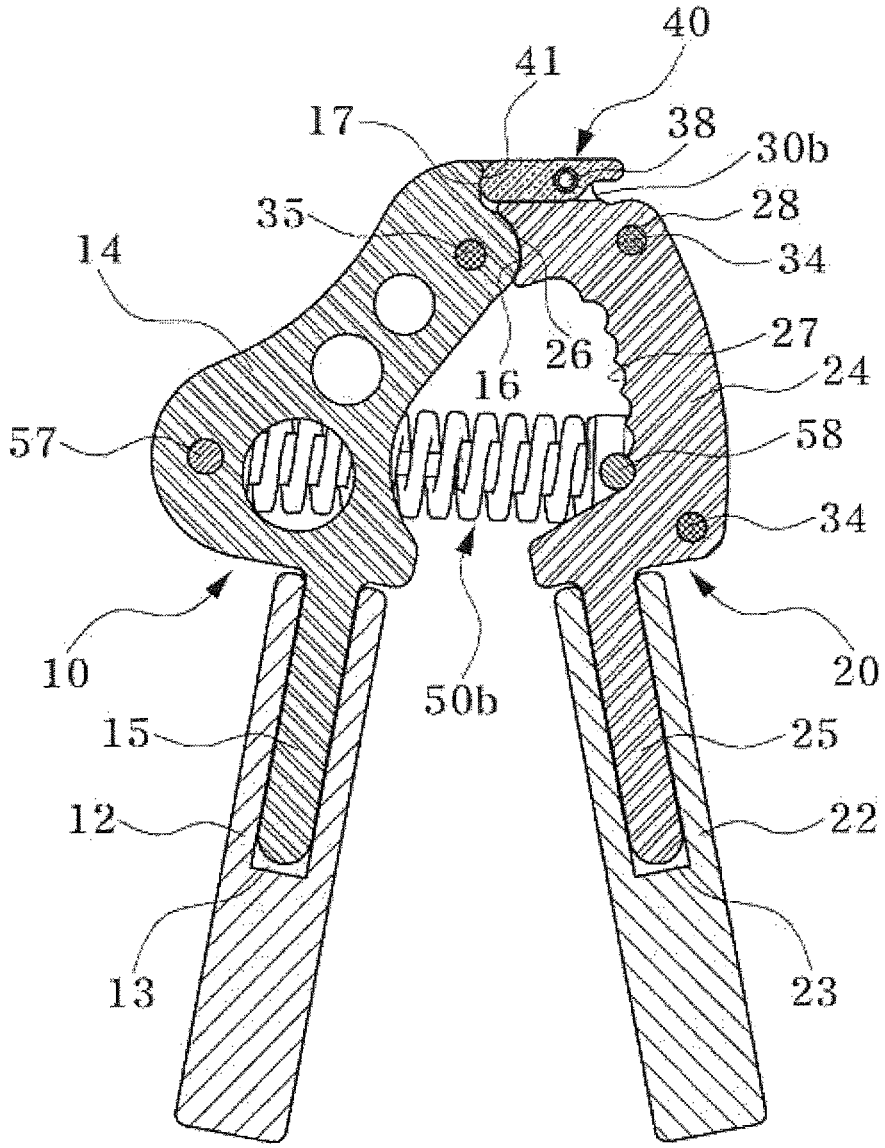
FIG. 7 is a cross-sectional view of the assembled handgrip according to one embodiment of the present invention.

Hereinafter, a process of adjusting the resilient force of the handgrip of the present invention will be described with reference to the handgrip illustrated in FIGS. 7, 11 and 12 according to the one embodiment of the present invention.

FIG. 11 is a cross-sectional view of the handgrip according to one embodiment of the present invention, which illustrates a state in which the stop member 40 is rotated around the hinge shaft 38. Compared with FIG. 7, it may be understood that the stop member 40 is moved from the restriction position of FIG. 7 to the control position of FIG. 11.

As illustrated in FIG. 11, in order to adjust the intensity of the resilient force, first, the control piece 44 of the stop member 40 is pushed, and then the stop member 40 is rotated to the right side around the hinge shaft 38. When the control piece 44 of the stop member 40 is pushed in a state in which the left and right arms 10 and 20 slightly approach each other and the left end contact surface 41 of the stop member 40 is spaced from the contact part 17, the stop member 40 is easily rotated.

While the stop member is in the control position, the left end contact surface 41 of the stop member 40 is deviated from a position which is in contact with the contact part 17 of the left plate body 14, and thus the left arm 10 may be rotated with respect to the right arm 20 to a position in which the resilient force is not applied. Since the right spring member coupling shaft 58 is deviated from the resilient force control grooves 27 in the no-load state in which the resilient force of the spring members 50*a* and 50*b* is not applied, the spring members 50*a* and 50*b* may be rotated around the left spring member coupling shaft 57. In this state, the right spring member coupling shaft 58 is moved to one of the resilient force control grooves 27 desired by the user, and the left and right arms 10 and 20 approach each other, and the stop member 40 is returned to its original position, and thus the controlling of the resilient force is completed.

Figure 12:
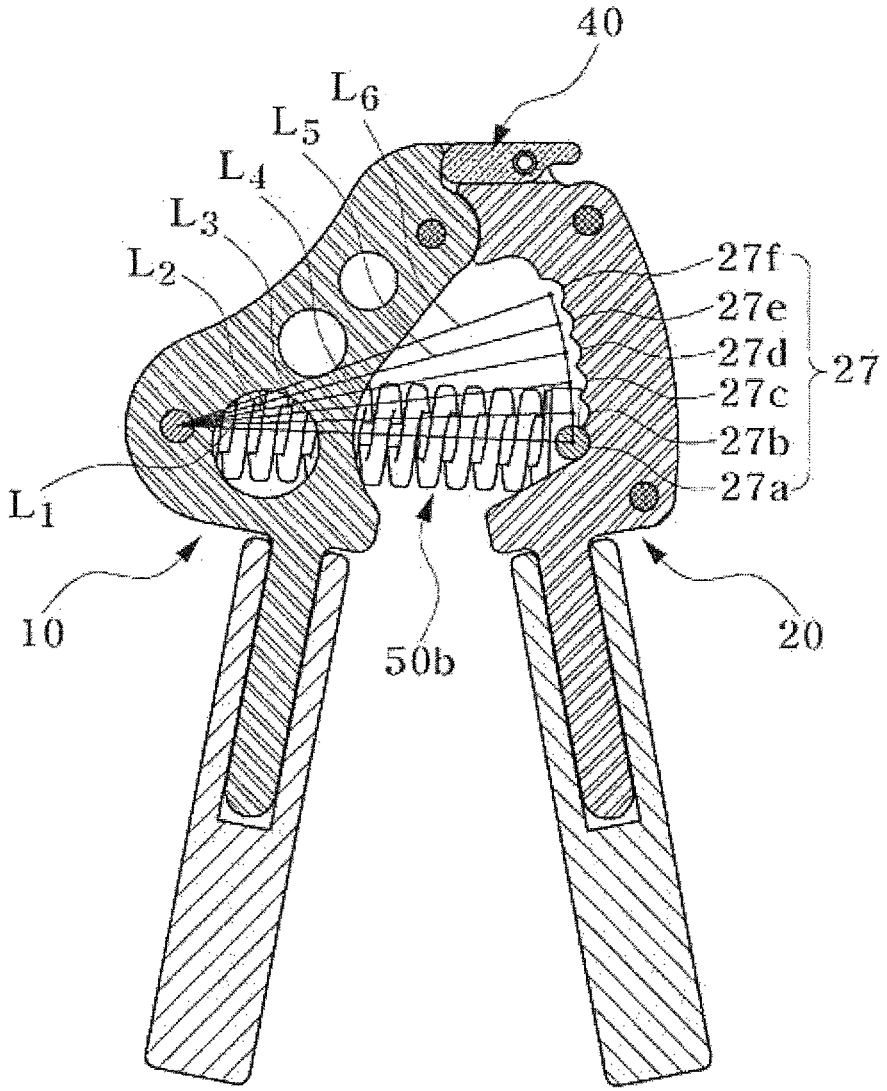
FIG. 12 is a cross-sectional view illustrating an operation of controlling the resilient force by controlling a position of the spring member in the handgrip according to one embodiment of the present invention.

FIG. 12 is a cross-sectional view of the handgrip, which illustrates movable positions of the spring members 50*a* and 50*b*. As illustrated in FIG. 12, the handgrip of the present invention may control the intensity of the resilient force according to the number of the resilient force control grooves 27. When the right spring member coupling shaft 58 is disposed at the resilient force control grooves 27*a*, 27*b*, 27*c*, 27*d*, 27*e* and 27*f*, resilient force operating lines L1, L2, L3, L4, L5 and L6 by the spring members 50*a* and 50*b* are formed. As positions of the resilient force operating lines L1, L2, L3, L4, L5 and L6 are changed, distances between the resilient force operating lines L1, L2, L3, L4, L5 and L6 and the rotating shaft 35 are changed, and thus the intensity of the resilient force is also changed. In the embodiment illustrated in FIG. 12, the intensity of the resilient force may be controlled in 6 stages. However, the stages may be increased or reduced depending on the embodiments.

Since the handgrip having the above-described structure has the spring members 50*a* and 50*b* at the front and back sides thereof, respectively, the intensity of the resilient force may be considerably increased, compared with the case in which one spring member is disposed between the left and right arms 10 and 20. Also, since the spring members 50*a* and 50*b* are disposed at outsides of the left and right arms 10 and 20, instead of insides thereof, a size of each of the spring members 50*a* and 50*b* may be increased without any interference. The resilient force provided by the compression spring 59 depends on a thickness, a wound diameter and a length of a spring wire forming the compression spring 59. Since the spring members 50*a* and 50*b* are disposed at the outsides and thus have no interference with other elements, the thickness, the wound diameter and the length of the spring wire may be adjusted according to a design thereof.

Also, in the handgrip having the above-described structure, since the plate members manufactured in the cutting manner of the plate material formed of a metallic material through the laser processing or the press processing are used as main elements, it is possible to easily manufacture them, and the grip formed of the metal rod is also may be easily manufactured. Therefore, the handgrip may be easily manufactured at a low cost, compared with the method using the mold formed of a metallic material. Also, since each element of the handgrip may be formed of the metallic material, a sufficient supporting force may be ensured, even when the strength of the spring members 50*a* and 50*b* is increased.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A handgrip comprising left and right arms in which upper portions thereof are coupled to each other by a rotating shaft so as to rotate around the rotating shaft, thereby approaching each other and being spaced apart from each other, and lower portions thereof are held by a user's hand, and a resilient means for providing a resilient force in the direction obstructing the approaching of the left and right arms, wherein the resilient means comprises spring members symmetrically installed on front and back sides of the upper portions of the left and right arms, respectively, and each of the front and back side spring members comprises a compression spring, and left and right spring support portions in which the compression spring is interposed therebetween to be supported in a compressible manner, and the left spring support portions of the front and back side spring members are connected to each other by a left spring member coupling shaft interposing through the upper portion of the left arm, and the right spring support portions of the front and back side spring members are connected to each other by a right spring member coupling shaft positioned adjacent the upper portion of the right arm, and thereby the front and back side spring members are operated in an integrated manner.

2. The handgrip of claim 1, wherein the left arm comprises a cylindrical left grip disposed at a lower portion thereof, and a left plate body disposed at an upper portion thereof and configured in a plate coupled with the left grip, and the right arm comprises a cylindrical right grip disposed at a lower portion thereof, and a right plate body disposed at an upper portion thereof and configured in a plate coupled with the right grip.

3. The handgrip of claim 2, wherein the right arm further comprises front and back side connecting plates which are coupled to front and back sides of the right plate body, respectively, and of which upper ends extend left so as to interpose an upper end of the left plate body therebetween, and the left plate body is interposed between the front and back side connecting plates and then rotatably coupled therewith by the rotating shaft installed to pass therethrough.

4. The handgrip of claim 3, wherein the left and right plate bodies and the front and back side connecting plates are manufactured by cutting a plate material formed of a metallic material, and the left and right grips are formed of a metal rod.

5. The handgrip of claim 3, wherein an arc-shaped sliding surface centering on the rotating shaft is formed at an right upper end surface of the left plate body, and a corresponding sliding surface having a corresponding shape and engaged with the sliding surface to be slidably rotated is formed at a left upper end surface of the right plate body.

6. The handgrip of claim 2, wherein the left spring member coupling shaft configured to connect the left spring support portions of the front and back side spring members is rotatably installed through a coupling shaft through-hole formed at the left plate body, and the right spring member coupling shaft configured to connect the right spring support portions of the front and back side spring members is installed at a left surface of the right plate body to be movable in a lengthwise direction.

7. The handgrip of claim 6, wherein a plurality of resilient force control grooves are formed at a left surface of the upper portion of the right arm in the lengthwise direction, and a middle portion of the right spring member coupling shaft is coupled to one of the resilient force control grooves.

8. The handgrip of claim 7, wherein a stop member disposed between the front and back side connecting plates coupled to the front and back sides of the right plate body, respectively, coupled to the front and back side connecting plates to be rotated around a hinge shaft, and having a left end contact surface which is in contact with a contact part formed at a left end thereof to be directed to an upper end of the left plate body is disposed at an upper surface of the right plate body, and the stop member has a restriction position in which the left end contact surface is disposed to be in contact with the contact part and thus to restrict a rotation between the left and right arms within a predetermined range, and a control position in which the stop member is deviated from the restriction position by rotating around the hinge shaft, and thus the left and right arms are allowed to be rotated with respect to each other to a position in which the resilient force of the spring members is not applied.

9. The handgrip of claim 8, wherein an elastic pressing part configured to press a lower surface of the stop member is formed at the upper surface of the right plate body, such that the stop member is prevented from being freely rotated by its own weight.

10. The handgrip of claim 9, wherein the elastic pressing part comprises a spring installed at an inside of a spring installing groove formed at the upper surface of the right plate body, and a bead-shaped locking ball elastically supported by the spring so as to press the lower surface of the stop member, and a plurality of catching grooves to which the locking ball is coupled are formed at the lower surface of the stop member.

11. The handgrip of claim 2, wherein the left and right grips further comprise cylinder-shaped left and right extending grips coupled to lower end surfaces of the left and right grips to increase lengths thereof.

* * * * *